US011081097B2

(12) United States Patent
Petersen et al.

(10) Patent No.: US 11,081,097 B2
(45) Date of Patent: Aug. 3, 2021

(54) PASSIVE BALANCING OF ELECTROACOUSTIC TRANSDUCERS FOR DETECTION OF EXTERNAL SOUND

(71) Applicant: ESS Technology, Inc., Milpitas, CA (US)

(72) Inventors: Christian Leth Petersen, Burnaby (CA); Shawn William Scarlett, San Francisco, CA (US); A. Martin Mallinson, Kelowna (CA)

(73) Assignee: ESS Technology, Inc., Milpitas, CA (US)

( * ) Notice: Subject to any disclaimer, the term of this patent is extended or adjusted under 35 U.S.C. 154(b) by 0 days.

(21) Appl. No.: 16/917,085

(22) Filed: Jun. 30, 2020

(65) Prior Publication Data

US 2021/0005175 A1 Jan. 7, 2021

Related U.S. Application Data

(60) Provisional application No. 62/869,557, filed on Jul. 1, 2019.

(51) Int. Cl.
*G10K 11/178* (2006.01)
*H04R 1/10* (2006.01)

(52) U.S. Cl.
CPC .. *G10K 11/17823* (2018.01); *G10K 11/17854* (2018.01); *G10K 11/17881* (2018.01); *H04R 1/1083* (2013.01); *G10K 2210/1081* (2013.01); *G10K 2210/30281* (2013.01)

(58) Field of Classification Search
CPC ..... G10K 11/17823; G10K 11/17881; G10K 11/17854; G10K 2210/1081; G10K 2210/30281; H04R 1/1083
USPC ..... 381/71.1, 71.8, 71.9, 71.11, 74, 93–94.9, 381/401
See application file for complete search history.

(56) References Cited

U.S. PATENT DOCUMENTS 3,879,720 A 4/1975 Duscheck
8,686,850 B2 4/2014 Zeng et al.
(Continued)

OTHER PUBLICATIONS

A. J. Bedard, Jr., et al., "The infrasound Network (ISNET): Background, design details, and display capability as an 88D adjunct tornado detection tool", National Oceanic and Atmospheric Administration, Environmental Technology Laboratory, Boulder, Colorado, Jan. 2004.

*Primary Examiner* — Norman Yu
(74) *Attorney, Agent, or Firm* — Gard & Kaslow LLP

(57) ABSTRACT

A system and method for passively balancing electroacoustic transducers so that sounds other than the transducer's output can be detected. A transducer producing audio output based upon an input audio signal can operate in reverse to produce a signal in response to the impact of external sound upon the transducer from another source. This "reverse" or "microphone" signal represents the sound from the other source. Transducers are operated in monophonic mode, each in opposite polarity to the other thus canceling out and leaving only the microphone signal created by the transducers, i.e., a signal representing the external sound. The microphone signal can be amplified, and can be filtered and processed to identify and/or obtain various types of information about the sound received by the transducers.

20 Claims, 7 Drawing Sheets

(56) References Cited

U.S. PATENT DOCUMENTS

| | | | | |
|---|---|---|---|---|
| 2009/0017878 | A1* | 1/2009 | Romesburg | H04M 1/03 455/570 |
| 2018/0167731 | A1* | 6/2018 | Ohta | B60R 11/02 |

* cited by examiner

PASSIVE BALANCING OF ELECTROACOUSTIC TRANSDUCERS FOR DETECTION OF EXTERNAL SOUND

This application claims priority to Provisional Application No. 62/869,557, filed Jul. 1, 2019, which is incorporated by reference herein in its entirety.

FIELD OF THE INVENTION

The present invention relates generally to electroacoustic transducers and more specifically to the operation of such transducers in a way that allows for the detection of external sound, i.e., not from the transducers.

BACKGROUND OF THE INVENTION

Many electronic devices today may be used with, or in some cases may require, electroacoustic transducers, commonly known as headphones, ear buds, or loudspeakers, that produce sound for a user. Some electroacoustic transducers only reproduce such audio for the user. A transducer system 100 having a conventional arrangement that is often used in stereo headphones is shown in FIG. 1. In such an arrangement there are typically two nominally identical transducers each containing a voice coil 102 and a diaphragm 104. Each voice coil 102 is driven by an amplifier 106, which causes the voice coil 102 to drive the diaphragm 104 thereby converting an audio signal into sound that a user can hear. In conventional stereo systems, two independent audio signals, each representing a separate channel, drive two independent transducers sharing a common electrical ground as illustrated.

In many applications, it is desirable to an audio system that is capable of both producing audio output for a user and receiving audio input from the user or other sources in the environment. For example, telephones and voice interface systems, which use speech recognition to understand spoken commands and answer questions, provide audio output that the user hears and also receive speech from the user as part of a phone conversation or as input to the voice interface system. Phone and voice interface systems are typically implemented with independent subsystems, one for the transducer(s) (such as shown in FIG. 1) and another for a microphone (not shown).

It is known that an electroacoustic transducer is in principle itself capable of acting as both an actuator that produces sound and a detector that can receive sound. However, current systems that use such transducers to detect external sound, i.e., sound from a source in the environment other than the transducers or their conventional supporting circuitry or amplifiers, use additional active circuitry to do so, or only allow operation in a push-to-talk or half-duplex mode. It would be useful to be able to make a system using electroacoustic transducers that can both produce and receive sound without the cost or complexity of additional active components or a separate microphone, but rather by operating the transducers only in their normal, "passive," fashion.

SUMMARY OF THE INVENTION

An improved system and method for passively balancing loudspeakers so that sounds that are produced by a source in the environment that is external to the loudspeakers may be detected is disclosed.

One embodiment discloses a method of using electroacoustic transducers to detect an environmental sound received by but not produced by the electroacoustic transducers, comprising: receiving a monophonic audio signal; providing the monophonic audio signal to a first voice coil, the first voice coil driving a first diaphragm; inverting the monophonic audio signal; providing the inverted monophonic audio signal to a second voice coil, the second voice coil driving a second diaphragm; and receiving at a common electrical point coupled to the first and second voice coils the monophonic audio signal and the inverted monophonic audio signal, causing the monophonic audio signal and the inverted monophonic audio signal to cancel out thereby creating a residual output signal that represents the environmental sound received by the first and second diaphragms.

Another embodiment discloses a method of using electroacoustic transducers to detect environmental sound not produced by the electroacoustic transducers, comprising: receiving a monophonic audio signal; providing the monophonic audio signal to a first voice coil and a second voice coil, the first voice coil driving a first sound-reproducing diaphragm, and the second voice coil having an opposite polarity from the first voice coil and driving a second sound-reproducing diaphragm; and receiving at a common electrical point coupled to the first and second voice coils the monophonic audio signal from the first voice coil and the monophonic audio signal from the second voice coil having the opposite polarity from the first voice coil thereby causing the monophonic audio signal from the first voice coil and the monophonic audio signal from the second voice coil to cancel out thereby creating a residual output signal that represents the environmental sound received by the first and second diaphragms.

Still another embodiment discloses a circuit for using electroacoustic transducers to detect an environmental sound received by but not produced by the electroacoustic transducers, comprising: a first amplifier configured to provide a monophonic audio signal to a first voice coil, the first voice coil driving a first diaphragm; a second amplifier configured to invert the monophonic audio signal and provide the inverted monophonic audio signal to a second voice coil, the second voice coil driving a second diaphragm; and an amplifier coupled to a common electrical point of the first and second voice coils and configured to receive the monophonic audio signal and the inverted monophonic audio signal, causing the monophonic audio signal and the inverted monophonic audio signal to cancel out thereby creating a residual output signal that represents the environmental sound received by the first and second diaphragms.

Yet another embodiment discloses a circuit for using electroacoustic transducers to detect an environmental sound received by but not produced by the electroacoustic transducers, comprising: a first amplifier configured to provide a monophonic audio signal to a first voice coil, the first voice coil driving a first diaphragm; a second amplifier configured to provide the monophonic audio signal to a second voice coil, the second voice coil having an opposite polarity from the first voice coil and driving a second diaphragm; and an amplifier coupled to a common electrical point of the first and second voice coils, causing the monophonic audio signal from the first voice coil and the monophonic audio signal from the second voice coil to cancel out thereby creating a residual output signal that represents the environmental sound received by the first and second diaphragms.

DETAILED DESCRIPTION OF THE INVENTION

Figure 1:
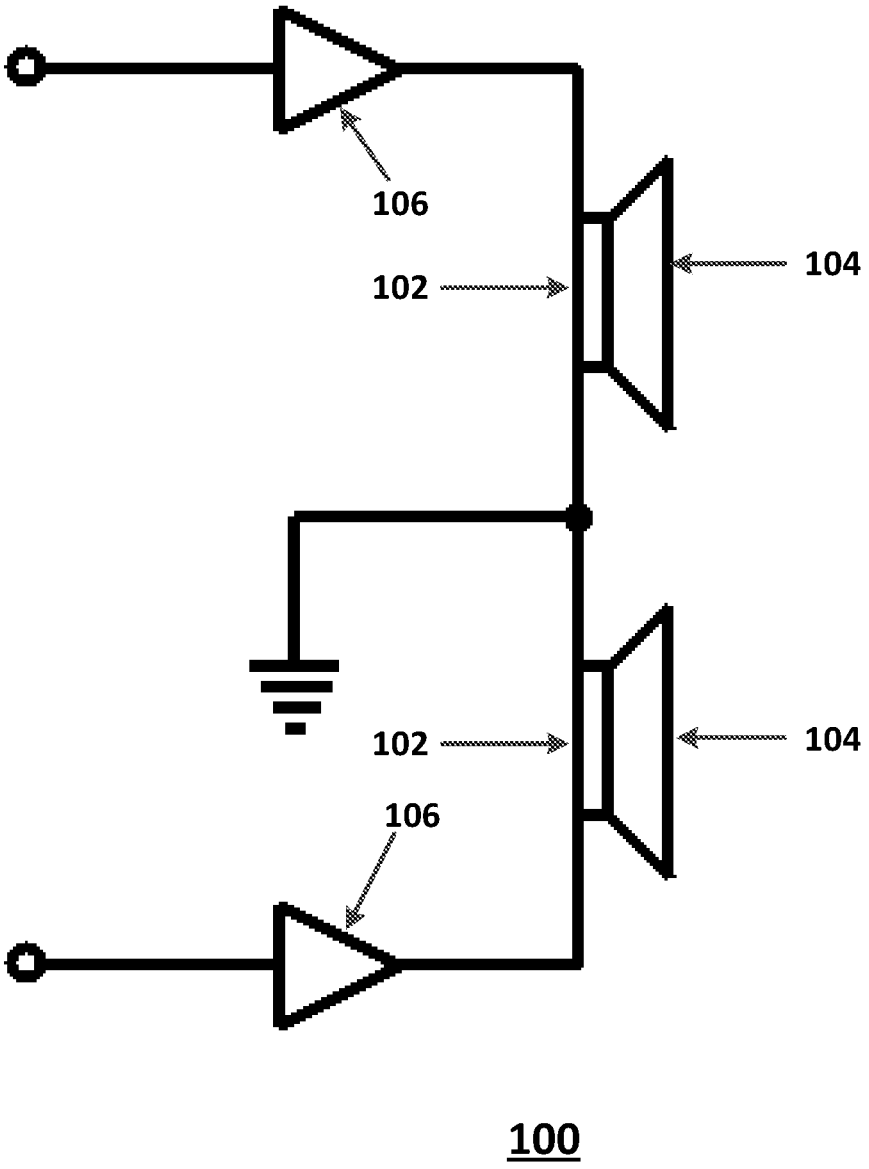
Fig. 1 (Prior art)
FIG. 1 is a diagrammatic representation of a prior art electroacoustic transducer system with a conventional arrangement that is often used in stereo systems.

A system and method for passively balancing electroacoustic transducers for operation so that sounds in the environment that are received by, but not produced by, the transducers may be detected is disclosed. The system and method utilize the fact that a transducer producing audio output based upon an input audio signal will often also produce a signal in response to the impact of sound that is produced by a source external to the transducer. This "reverse" or "microphone" signal is an audio signal representing the sound from the external source. However, prior art systems using this effect use additional, active components to detect the reverse signal, thus increasing their cost and complexity, rather than operating the transducers in their normal, or "passive" operation in which no such additional active components are required for detection of sound.

In some embodiments described herein, electroacoustic transducers are operated in monophonic mode, with one transducer providing a monophonic output that is of opposite phase to another transducer. A common electrical point between the transducers will thus receive two monophonic output signals of opposite phase that cancel each other out, leaving only the "microphone signal" created by environmental sound affecting the transducers, i.e., a signal representing the impact of such environmental sound on the transducers. The microphone signal can then be amplified, and can be filtered and processed to obtain various types of information about the sound received by the transducers, such as whether it represents speech by a user, biological signals representing a user's vital signs, or environmental events such as geophysical events or in some cases even sounds caused by someone in the vicinity of the transducers.

As used herein, an electroacoustic transducer, referred to herein as a transducer, is any device that converts electrical energy into sound energy by receiving an electrical audio signal and converting that audio signal into corresponding sound, including, without limitation, in-ear and over-the-ear headphones, conventional compact, bookshelf or floor-standing loudspeakers, and electrostatic, planar or ribbon loudspeakers. A transducer typically has a "voice coil" and a "diaphragm," the voice coil receiving the electrical audio signal so as to induce movement of the diaphragm, thereby causing movement of the surrounding air to create sound. "Voice coils" may be literal coils or wires of any shape that cause a diaphragm to move, while "diaphragms" include cones made of paper or other materials, horns, planar materials, or any other materials that move to cause the surrounding air to move and thereby create sound.

It is known in the art that any transducer that produces sound in response to an audio signal, such as the transducer in an in-ear or over-the-ear headphone or other type of loudspeaker, does so by moving a diaphragm of some type in response to the audio signal applied to it and thus producing a sound corresponding to the audio signal. The process works in reverse as well; when such a diaphragm is subjected to an external sound, it in turn produces an electrical signal, although this signal will typically be orders of magnitude smaller than the signal that is used to drive the transducer.

This is the same principle as that of a microphone, which produces an electrical signal in response to sound. The reverse signal produced in response to an external sound by a transducer normally used to produce sound may be thought of as a "back audio signal" or "ambient noise signal" to differentiate it from the audio signal that is normally applied to the transducer to cause it to produce sound. (Both microphones and transducers will also generate a signal in response to sound in the form of mechanical energy, as occurs when someone taps on a microphone or on a transducer in headphones.)

In some cases the audio detected by the transducers may be speech from a user, and the reverse audio signal created in response may be transmitted as part of a telephone call, as a command to or in response to a voice interface system, etc. This may be of particular interest in cases where a signal from a conventional microphone might be compromised by excessive external noise, for example, background noise from traffic, crowds, wind etc. For example, when transducers are part of a headphone assembly, they can also act as contact microphones (also known as piezo microphones, that are insensitive to air vibrations but transduce only structure-borne sound) that detect the voice of the user, similar to laryngophones used for communication in surveillance and aerospace applications, thus enabling enhanced communication under extreme conditions.

The described system and method omit a microphone as used in the prior art, and instead take advantage of this "microphone effect" of a transducer to provide a reverse microphone signal representative of the sound or mechanical vibration in the environment. Because, as above, the reverse microphone signal is much smaller than the audio signal input to the transducer, care must be taken in its detection and amplification to a signal large enough to be processed for its intended purpose, whether as speech or some other sound or form as known and/or described herein.

Figure 2:
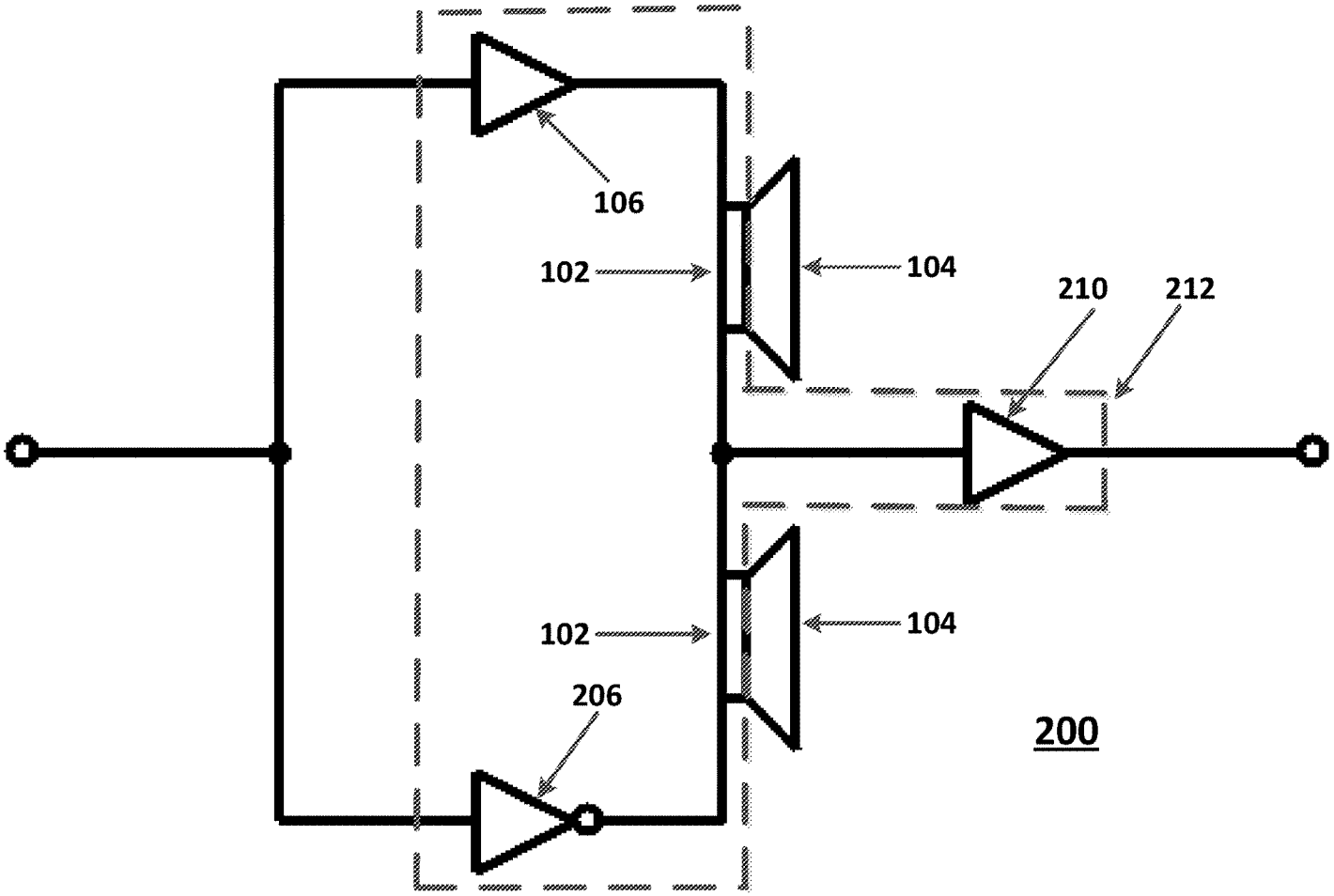
FIG. 2 is a diagrammatic representation of an electroacoustic transducer system for detecting sounds from a source in the environment external to the transducers according to one embodiment.

FIG. 2 is a diagrammatic representation of a transducer system for detecting sounds from a source other than the transducers according to one embodiment. As in system 100 of FIG. 1, in system 200 there are two nominally identical transducers each containing a voice coil 102 and a diaphragm 104. Each voice coil 102 is driven by an amplifier, which causes the voice coil 102 to drive the diaphragm 104 thereby converting an audio signal into sound that a user can hear.

In the present approach, however, rather than each voice coil receiving a separate channel of a stereo audio signal as in FIG. 1, in system 200 the two voice coils 102 receive the same monophonic signal but the input to one coil 102 is inverted, i.e., is in opposite phase, from the monophonic signal to the other coil 102. Thus, in system 200 one voice coil 102 is driven by an amplifier 106 providing the monophonic audio signal as in FIG. 1, while the other voice coil 102 is driven by an amplifier 206 that is nominally identical to amplifier 106 but provides the inverse of the monophonic audio signal. Amplifier 206 may perform the inversion of the monophonic audio signal, or a separate inverter may be used. The common electrical point between the two transducers is no longer coupled to a ground, but rather is the input to a microphone amplifier 210.

Since both transducers receive a monophonic audio signal and produce monophonic audio, the listener perceives the two opposite phase signals as a regular monophonic output; however, the opposite phase signals cancel at the common electrical point, i.e., the input to the microphone amplifier. In other words, the transducers form the arms of a balanced impedance bridge. Any external, environmental signal picked up by the transducers' "microphone action," such as speech, low-frequency oscillations or physical tapping in the area of or on the transducer, not produced by the transducer itself will be present as a bridge error signal at the microphone input. Furthermore, signals that are picked up at both transducers (including the voice of the user) add constructively, producing a greater, more easily detectable, amplitude at the microphone input.

The microphone input signal may be used in the same way that an input signal from a conventional microphone may be used in a phone, headset, voice interface system, or any other device that includes the ability to both produce and receive sound. The balancing scheme of the present embodiment can work with stereo headsets with one transducer in each ear, stereo or mono headsets with two or more transducers in each ear, and systems having one or more transducers with multiple voice coils.

In some embodiments, where the voice coils are actual coils or other structures that can have reversed polarity, for example, coils being wrapped in opposite directions, a single monophonic audio signal may be applied to both voice coils without inversion. The opposite directions of the coils' wrapping will result in one coil causing a diaphragm to generate sound having one phase and the other coil causing the other diaphragm to generate sound having the opposite phase, thus achieving the desired effect of the signals being applied to the diaphragms with opposite phases.

As will be explained below, external, environmental sounds or vibrations other than speech received by the transducers may be detected and processed.

System 200 is inherently not affected by temperature changes and self-heating, since as above the transducers are nominally identical and thus the change in impedance of each transducer due to temperature will change to the same degree. (One exception is when an in-ear stereo headset has one driver removed from the ear. This will create a difference in impedance that can be used to detect the removal of the transducer by measuring the amplitude of the residual output signal at the microphone input.)

In practice, the transducers in the system will not be absolutely identical (due to production variations and imperfections), and thus some residual of the output signal will be present at the microphone input. However, the amplitude of this residual output signal is typically reduced by 60 dB or more compared with the original output signal amplitude. This makes it feasible to remove the remaining residual signal with adaptive filtering.

Figure 3:
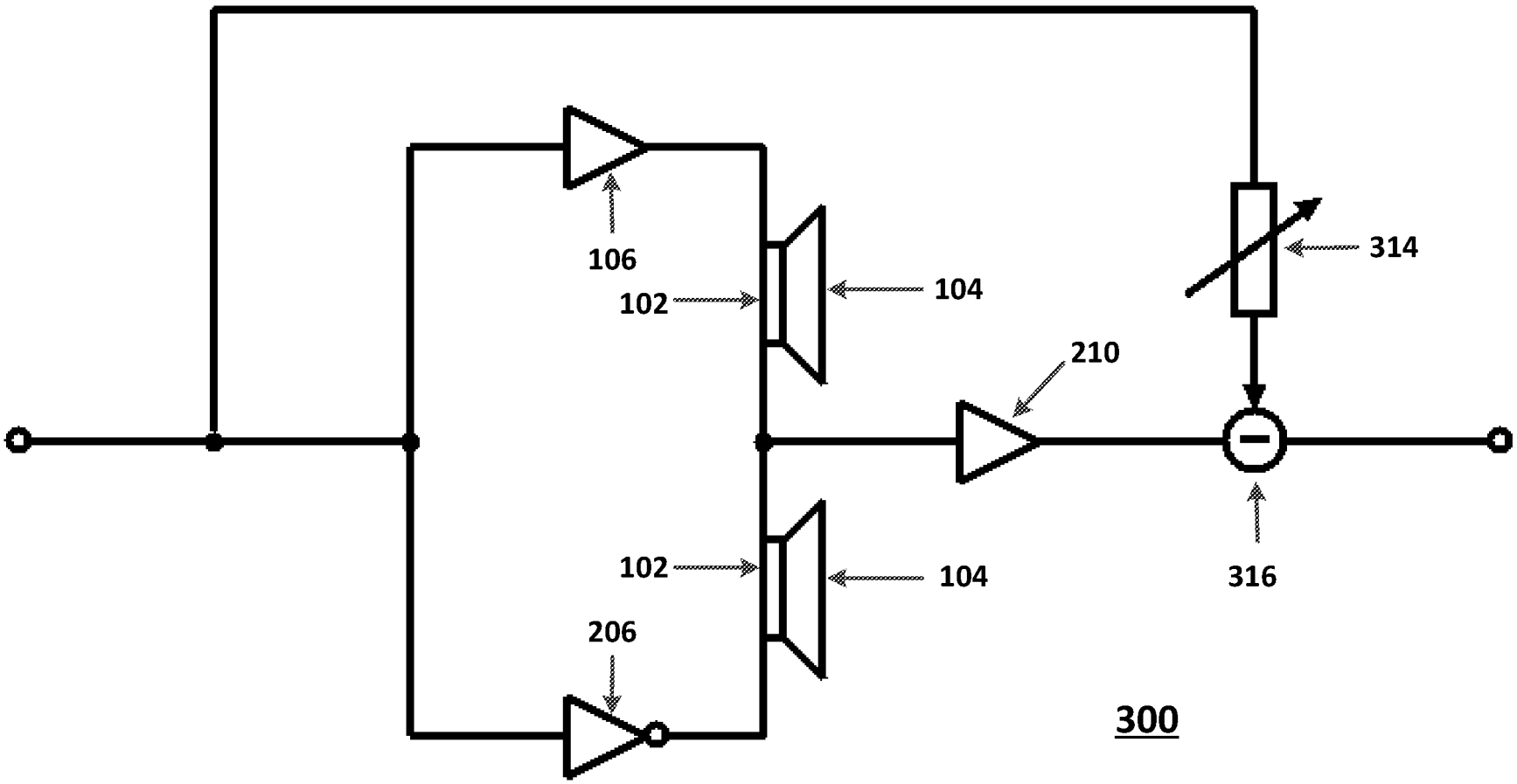
FIG. 3 is a diagrammatic representation of an electroacoustic transducer system for detecting sounds from a source in the environment external to the transducers according to another embodiment.

FIG. 3 is a diagrammatic representation of a transducer system 300 for detecting sounds from a source other than the transducers according to another embodiment that includes such adaptive filtering. System 300 is identical to system 200 of FIG. 2 except that the input audio signal (before amplification, and inversion, by amplifiers 106 and 206) is fed forward to filter 314, and the filtered signal is then subtracted from the microphone signal, which has been amplified by amplifier 210, by a differencing element 316. (Note that differencing element 316 may be any type of comparator, adder, or summer; in light of the teachings herein, one of skill in the art will understand when any particular component used as differencing element 316 requires inversion of the output of filter 314 and, if so, how to accomplish such inversion.)

Use of an appropriate filter as filter 314 removes the residual output signal. Filter 314 may be any filter that results in echo cancellation, such as an adaptive least mean square (LMS) filter, or any other filter for echo cancellation known in the art. This filtering step can be performed very effectively since the output signal is directly available as the filter reference.

One of skill in the art will appreciate that in various embodiments the filtering to remove the residual output signal shown as filter 314 in system 300 may be performed in different ways and/or places. In one embodiment, filter 312 may be implemented as a hardware or firmware adaptive filter located on an audio amplifier microchip that drives the transducers, such as may be found in on-ear or over-the-ear headphones. In such a case, the microchip might include the components within the dashed line 212 on FIG. 2, i.e., the amplifiers 106, 206 and 210, and, in some embodiments, may even include voice coils 102 as shown here.

In another embodiment, such filtering may involve computationally intense signal processing that is better run on a separate dedicated Digital Signal Processor (DSP) chip that intercepts the input audio signals from a host audio source, such as a smartphone or other application processor, to the audio amplifier microchip. In a third embodiment, the residual output signal removal may be performed within a software process running on the host audio source.

The host audio source can for example be the central processing unit of a computer, laptop, tablet, mobile phone or media player. The computationally intense algorithms involved in the signal noise removal can include Fourier transformation, convolution, neural network processing, least mean square adaptive filtering or any other technique for adaptive filtering and active noise cancellation known in the art, or combinations thereof.

Figure 4:
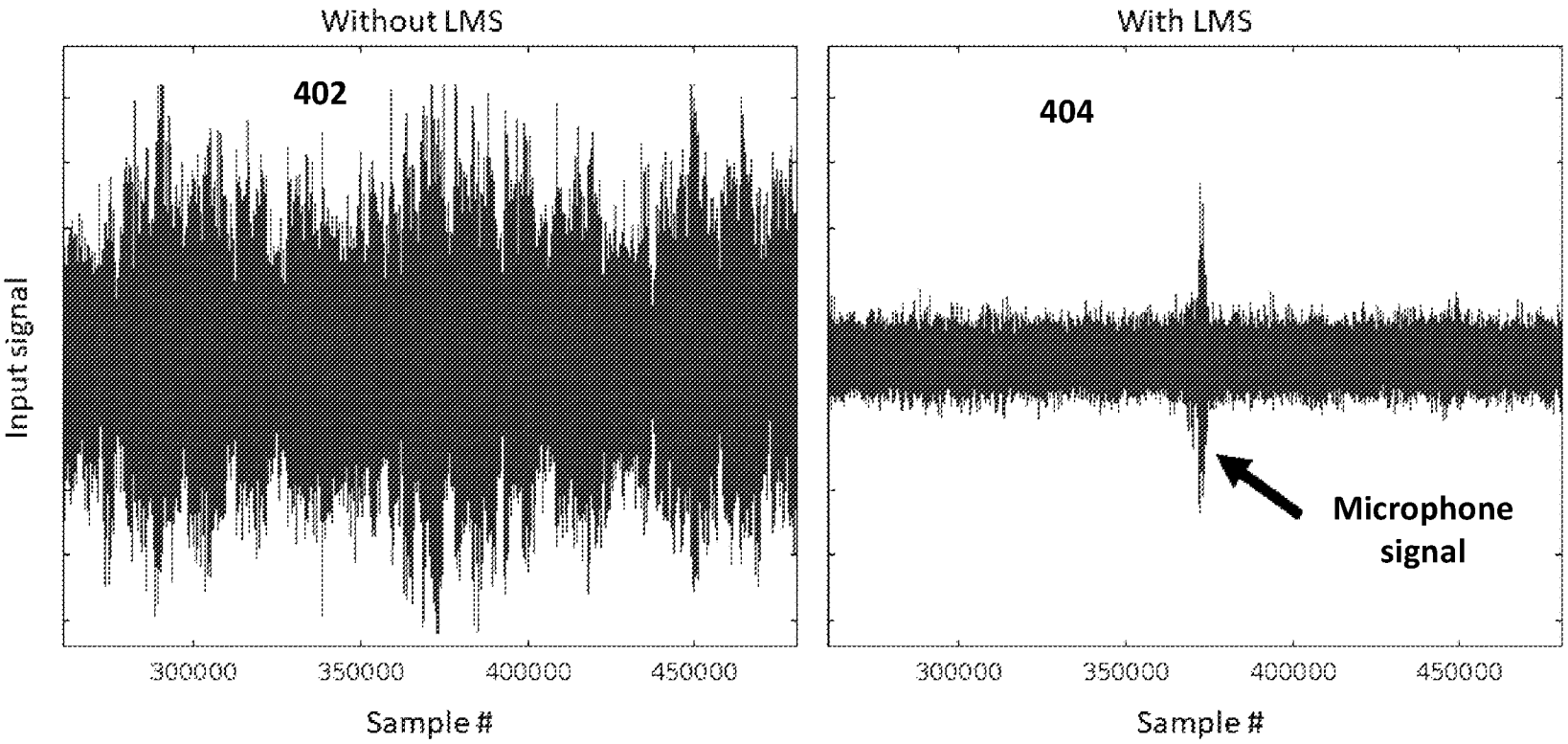
FIG. 4 illustrates graphs showing the effect of echo cancellation on the "microphone" input of a system such as that shown in FIG. 3.

An example of the effect of an echo cancellation stage such as filter 312 shown in FIG. 3 is illustrated in FIG. 4. Graph 402 on the left shows the unfiltered microphone signal while music is playing through the transducers at full volume. The unfiltered signal contains a residual of the transducers output due to the imperfect impedance matching of the balance bridge. However, this signal can be removed with filtering, revealing a valid microphone signal (here a spoken word) on graph 404 on the right.

In most telephony applications the use of filter 314 in system 300 of FIG. 3 is unnecessary as the host system (such as a smartphone or computer in the case of internet conferencing) already implements a software echo cancellation algorithm that will act to cancel the residual signal in the microphone input.

For use in basic telephony applications, the restriction of input to a monophonic signal is not a big concern as the communication is typically monophonic to begin with. However, when the transducers are also used for listening to music or other high-quality media content, the monophonic requirement is undesirable. The ability to switch between monophonic and stereo signals is thus desirable.

Figure 5:
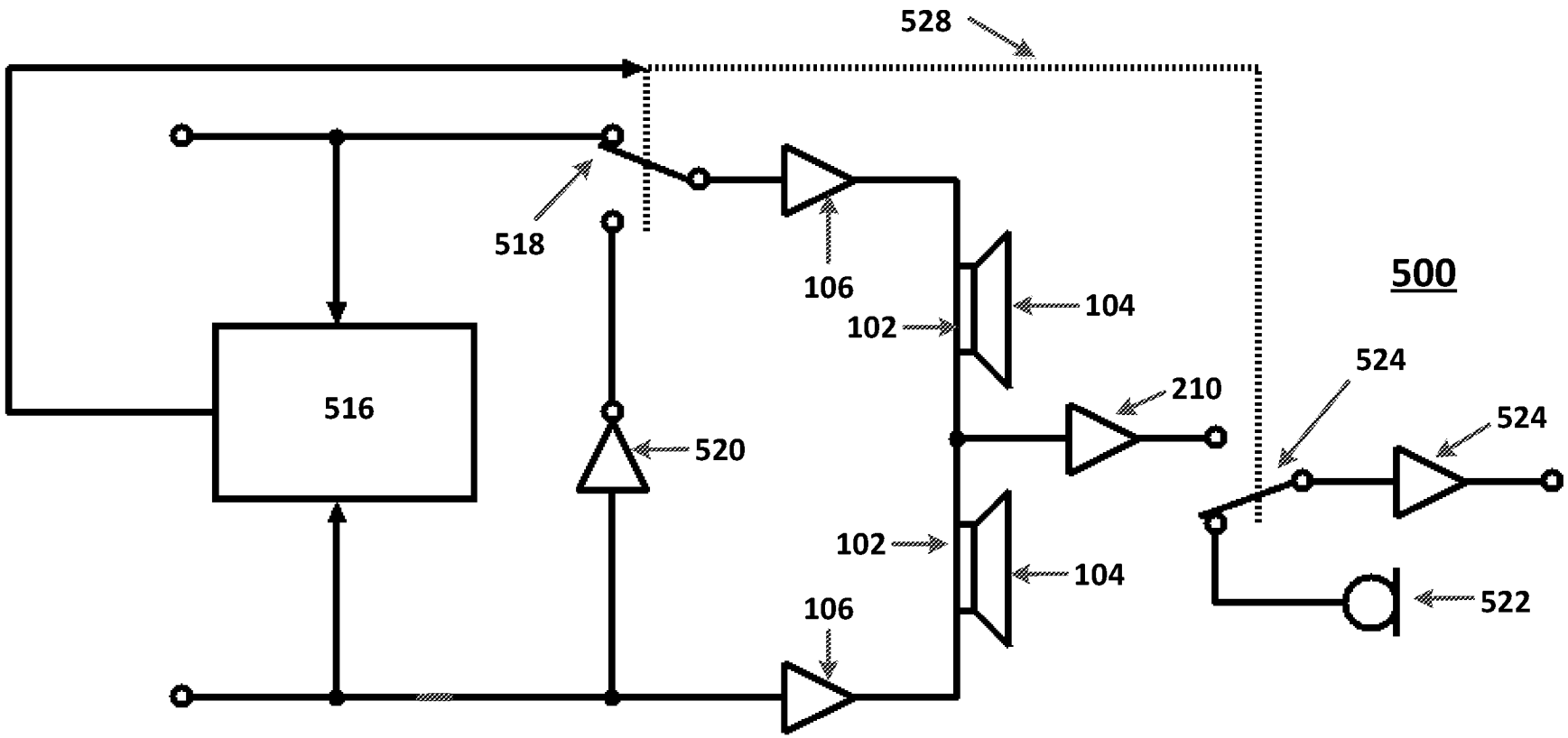
FIG. 5 is a diagrammatic representation of an electroacoustic transducer system for detecting sounds from a source other than the transducers that is capable of switching from stereo to monophonic operation according to another embodiment.

FIG. 5 is a diagrammatic representation of a transducer system 500 for detecting sounds from a source other than the transducers that is capable of switching from stereo to monophonic operation depending upon the application. Switching may be activated automatically when detecting the monophonic nature of a phone call, or alternatively may be configured at runtime by the host audio source depending on the current mode of operation.

System 500 adds to the components of system 200 of FIG. 2. When a stereo signal is present, system 500 operates in the same way as system 100 described above. The system receives two separate input signals, representing different channels of the overall input. Voice coils 102 are driven by amplifiers 106, which in turn drive diaphragms 104. In this mode, switch 518 is in the position indicated so that amplifiers 106 each receive a different channel of the stereo signal, and amplifier 210 functions as, or is connected to, a ground.

A monophonic signal detector 516 receives both input channels and detects when the input audio signal is monophonic rather than stereo. In such a case, switch 518 changes position, so that the single signal is received. One amplifier 106 receives the monophonic input signal while inverter 520 inverts the phase of the input signal so that the other amplifier 106 receives an anti-phase version of the monophonic input signal. System 500 now functions like circuit 200 of FIG. 2.

In an alternative embodiment, switchable system 500 can further include a regular microphone 522 for normal use, enabling the "transducer-based" microphone when the quality of the regular microphone signal is compromised. In such a case, a second switch 524 can be moved in response to a "microphone select" signal 528 that is again activated when the monophonic signal detector 516 detects a monophonic audio signal. Another amplifier 524 can be used to amplify the signal from the regular microphone 522.

A further application of system 500 (or system 200 of FIG. 2 or system 300 of FIG. 3) is for the transducers to detect very small signals, i.e., the reverse audio signal at the transducer microphone input, by placing the input amplifiers 106 (and 208) in a high impedance state or by grounding the output connections to the transducers so that there is no audio output from the transducer diaphragms 104. In such a case, the system is not being used to reproduce an input audio signal from the host audio source, but is rather acting as a very sensitive microphone. In addition, amplifier 210 may have very high gain to amplify the microphone signal obtained from the transducers.

In some embodiments very small low-frequency signals can be detected. For example, it is possible for in-ear and over-the-ear headphones to pick up the heart rate of the user due to minute modulations of the eardrum position and bone conduction of the blood pulsation in the carotid arteries that pass close to the ears.

Figure 6:
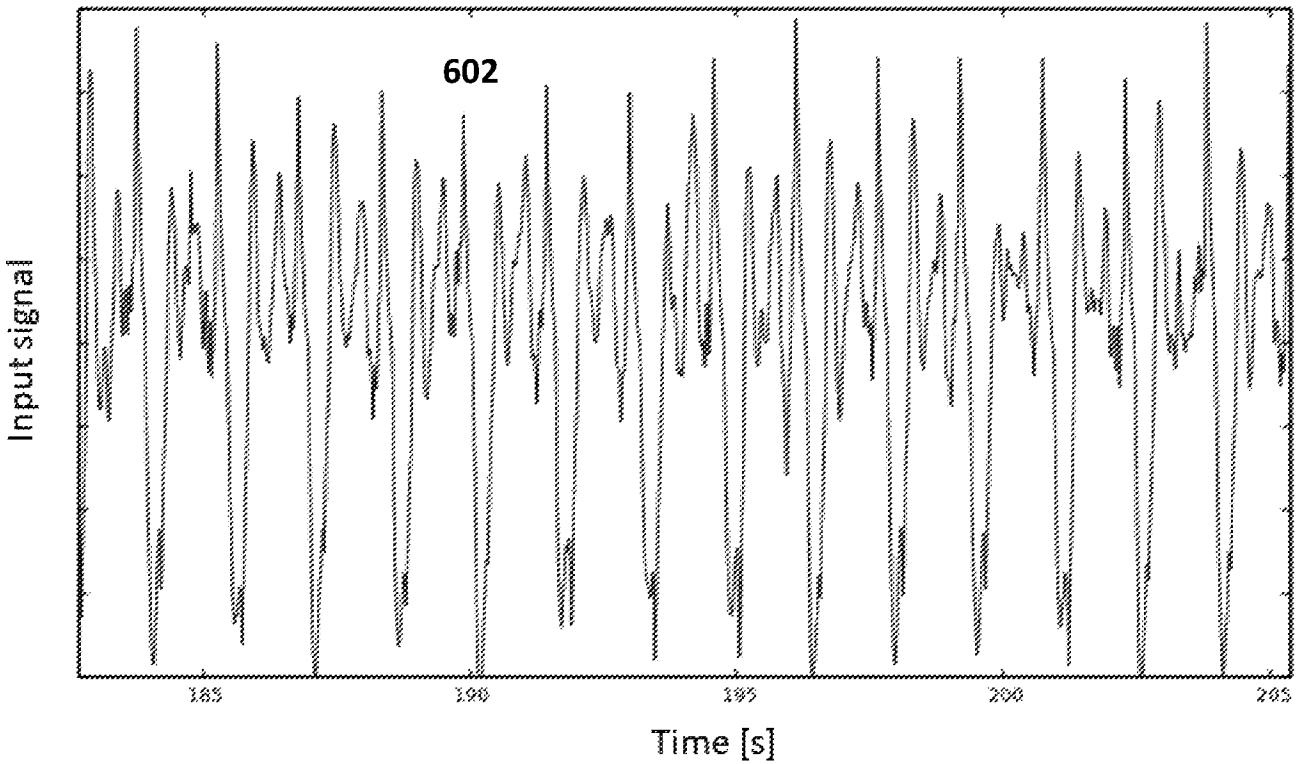
FIG. 6 illustrates a graph of a sample recording of a heart rate pulse signal.

FIG. 6 shows a graph 602 of an example recording of such a heart rate pulse signal. A system such as described herein, in which the transducers are in-ear or over-the-ear headphones as mentioned above, can enable such a measurement of the user's heart rate with a conventional stereo headset.

The removal of the residual output signal to form a clean microphone signal can be the first step in extracting specific biological signal features in the microphone signal, such as the user's heart rate, heart rate variability, respiratory rate or blood pressure, and/or other vital signs. Additional filtering can be used to process the clean microphone signal into a biological signal or other specific feature. This filtering can include any of band-pass filtering, non-linear filtering, adaptive filtering, peak detection or any combinations thereof known in the art. For example, a minimal system for the extraction of a heart rate signal might include applying a 0.5 Hz-4 Hz bandpass filter followed by a peak detection algorithm based on dynamic thresholding.

Sample rate decimation can be applied to lower the processing overhead associated with such biological feature extraction. The biological signal may often have a frequency that is much lower than a typical audio sampling rate. For example, a range of 100 Hz to 1000 Hz (1 kHz) is the typical sample rate range for photoplethysmogram and electroencephalogram data, which is much lower than the typical audio sampling rate range of 40 to 50 kHz.

As a practical matter, due to an anatomic asymmetry of the carotid arteries the heart pulse arrives at a slightly different phase in the user's two ears. This effect may also be detected by using a system as described herein, as illustrated in FIG. 7.

Figure 7:
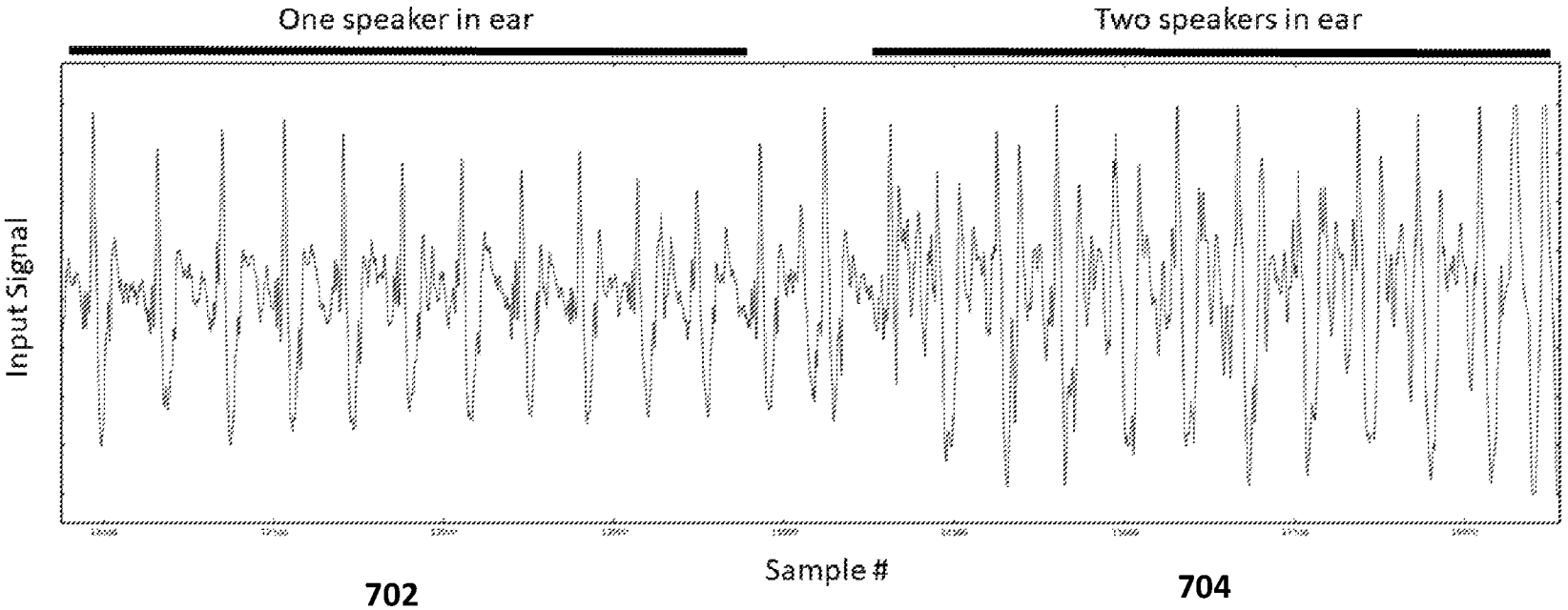
FIG. 7 illustrates a graph of another sample recording of a heart rate pulse signal.

In FIG. 7, in one instance the heartbeat is recorded in one ear only as shown in the left portion 702 of the graph, while the recording of the heart beat in both ears is shown in the right portion 704 of the graph. As may be clearly seen, the phase difference in the pulse arrival causes a double-peak effect. In addition, the amplitude of the heartbeat is seen to increase as expected from the additive nature of the transducers' microphone action.

The pulse phase effect can be used to detect which transducer is in which ear, or if one or both transducers are not in the ears; for example, detecting that one or both transducers are no longer in the user's ears may trigger a host audio source to stop playing music. Further, the phase shift is a form of pulse transit time measurement and thus contains information about the blood pressure of the user that may also be extracted and processed with suitable filters and algorithms.

In other embodiments, the microphone effect of transducers may be applied to detect environmental sounds such as low frequency oscillations from earthquakes and tornados, thus giving early warning to the wearer of imminent dangerous conditions. For example, it is known that sound at frequencies below 1 Hz (known as infrasound), while not audible to the human ear or detectable by conventional microphones, can provide information about geophysical processes, including tornados and other vortices. It is also known to use accelerometers to detect seismic waves associated with earthquakes; in such applications the accelerometers could be replaced by transducer microphones as described herein.

When network connectivity is available, such as that of a smartphone, computer, or connected home virtual assistant device, this type of information can be analyzed by a computing system in the cloud and may provide valuable identification and/or forecasting in the event of extreme weather conditions. Other external, environmental sounds that can be detected with the transducer acting as a microphone include footfalls and door slams, tapping on or near the transducer, and similar noise deriving from physical activity. Thus, for example, a transducer as microphone system could also function as a home intrusion alarm, if noises are detected when the home is expected to be empty and quiet.

It should also be appreciated that the described method and apparatus can be implemented in numerous ways, including as a process, an apparatus, or a system. The methods described herein may be implemented by program instructions for instructing a processor to perform such methods, and such instructions recorded on a non-transitory computer readable storage medium such as a hard disk drive, floppy disk, optical disc such as a compact disc (CD) or digital versatile disc (DVD), flash memory, etc. It may be possible to incorporate some methods into hard-wired logic if desired. It should be noted that the order of the steps of the methods described herein may be altered and still be within the scope of the disclosure.

It is to be understood that the examples given are for illustrative purposes only and may be extended to other implementations and embodiments with different conventions and techniques. While a number of embodiments are described, there is no intent to limit the disclosure to the embodiment(s) disclosed herein. On the contrary, the intent is to cover all alternatives, modifications, and equivalents apparent to those familiar with the art.

In the foregoing specification, the invention is described with reference to specific embodiments thereof, but those skilled in the art will recognize that the invention is not limited thereto. Various features and aspects of the above-described invention may be used individually or jointly. Further, the invention can be utilized in any number of environments and applications beyond those described herein without departing from the broader spirit and scope of the specification. The specification and drawings are, accordingly, to be regarded as illustrative rather than restrictive. It will be recognized that the terms "comprising," "including," and "having," as used herein, are specifically intended to be read as open-ended terms of art.

What is claimed is:

1. A method of using electroacoustic transducers to detect an environmental sound received by but not produced by the electroacoustic transducers, comprising:

receiving a monophonic audio signal;

providing the monophonic audio signal to a first voice coil, the first voice coil driving a first diaphragm;

inverting the monophonic audio signal;

providing the inverted monophonic audio signal to a second voice coil, the second voice coil driving a second diaphragm; and receiving at a common electrical point coupled to the first and second voice coils the monophonic audio signal and the inverted monophonic audio signal, causing the monophonic audio signal and the inverted monophonic audio signal to cancel out thereby creating a residual output signal that represents the environmental sound received by the first and second diaphragms.

2. The method of claim 1 further comprising amplifying the residual output signal.

3. The method of claim 1 further comprising amplifying the monophonic audio signal before providing the monophonic audio signal to the first voice coil, and amplifying the inverted monophonic audio signal before providing the inverted monophonic audio signal to the second voice coil.

4. The method of claim 1 further comprising performing echo cancellation on the residual output signal.

5. The method of claim 4 wherein echo cancellation is performed by:

filtering the monophonic audio signal; and subtracting the filtered monophonic audio signal from the residual output signal.

6. The method of claim 5 wherein the filtering is least-mean-square filtering.

7. A method of using electroacoustic transducers to detect environmental sound not produced by the electroacoustic transducers, comprising:

receiving a monophonic audio signal;

providing the monophonic audio signal to a first voice coil and a second voice coil, the first voice coil driving a first sound-reproducing diaphragm, and the second voice coil having an opposite polarity from the first voice coil and driving a second sound-reproducing diaphragm; and receiving at a common electrical point coupled to the first and second voice coils the monophonic audio signal from the first voice coil and the monophonic audio signal from the second voice coil having the opposite polarity from the first voice coil thereby causing the monophonic audio signal from the first voice coil and the monophonic audio signal from the second voice coil to cancel out thereby creating a residual output signal that represents the environmental sound received by the first and second diaphragms.

8. The method of claim 7 further comprising amplifying the residual output signal.

9. The method of claim 7 further comprising amplifying the monophonic audio signal before providing the monophonic audio signal to the first voice coil and the second voice coil.

10. The method of claim 7 further comprising performing echo cancellation on the residual output signal.

11. The method of claim 10 wherein echo cancellation is performed by:

filtering the monophonic audio signal; and subtracting the filtered monophonic audio signal from the residual output signal.

12. The method of claim 11 wherein the filtering is least-mean-square filtering.

13. A circuit for using electroacoustic transducers to detect an environmental sound received by but not produced by the electroacoustic transducers, comprising:

a first amplifier configured to provide a monophonic audio signal to a first voice coil, the first voice coil driving a first diaphragm;

a second amplifier configured to invert the monophonic audio signal and provide the inverted monophonic audio signal to a second voice coil, the second voice coil driving a second diaphragm; and an amplifier coupled to a common electrical point of the first and second voice coils and configured to receive the monophonic audio signal and the inverted monophonic audio signal, causing the monophonic audio signal and the inverted monophonic audio signal to cancel out thereby creating a residual output signal that represents the environmental sound received by the first and second diaphragms.

14. The circuit of claim 13 further comprising a component for performing echo cancellation on the residual output signal.

15. The circuit of claim 14 wherein the component for performing echo cancellation further comprises:

a filter configured to filter the monophonic audio signal; and a differencing element configured to subtract the filtered monophonic audio signal from the residual output signal.

16. The method of claim 15 wherein the filter is a least-mean-square filter.

17. A circuit for using electroacoustic transducers to detect an environmental sound received by but not produced by the electroacoustic transducers, comprising:

a first amplifier configured to provide a monophonic audio signal to a first voice coil, the first voice coil driving a first diaphragm;

a second amplifier configured to provide the monophonic audio signal to a second voice coil, the second voice coil having an opposite polarity from the first voice coil and driving a second diaphragm; and an amplifier coupled to a common electrical point of the first and second voice coils, causing the monophonic audio signal from the first voice coil and the monophonic audio signal from the second voice coil to cancel out thereby creating a residual output signal that represents the environmental sound received by the first and second diaphragms.

18. The circuit of claim 17 further comprising a component for performing echo cancellation on the residual output signal.

19. The circuit of claim 18 wherein the component for performing echo cancellation further comprises:

a filter configured to filter the monophonic audio signal; and a differencing element configured to subtract the filtered monophonic audio signal from the residual output signal.

20. The method of claim 19 wherein the filter is a least-mean-square filter.

* * * * *